US008791779B2

(12) United States Patent
Jonsson

(10) Patent No.: US 8,791,779 B2
(45) Date of Patent: Jul. 29, 2014

(54) FAST SWITCH WITH NON-CIRCULAR THOMSON COIL

(75) Inventor: Lars E. Jonsson, Västeras (SE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/549,043

(22) Filed: Jul. 13, 2012

(65) Prior Publication Data

US 2013/0015930 A1 Jan. 17, 2013

(30) Foreign Application Priority Data

Jul. 14, 2011 (EP) ..... 11173994

(51) Int. Cl.

| | |
|---|---|
| ***H01H 67/02*** | (2006.01) |
| ***H01H 63/02*** | (2006.01) |
| ***H01H 33/00*** | (2006.01) |
| ***H01H 1/22*** | (2006.01) |
| ***H01H 50/32*** | (2006.01) |

(52) U.S. Cl.

CPC ..... *H01H 1/226* (2013.01); *H01H 50/323* (2013.01)

USPC ..... 335/107; 335/106; 335/121; 335/126; 335/127; 335/133; 335/134; 200/239; 218/92; 218/107; 218/110; 218/146

(58) Field of Classification Search

CPC ..... H01H 1/226; H01H 50/323

USPC ..... 335/71–72, 75, 87–89, 91–92, 97, 335/106–107, 121, 126, 127, 133–134, 136, 335/184, 185, 192, 195, 201, 202; 200/1 R, 200/275, 239, 241, 272, 274; 218/91, 92, 218/96, 107, 110, 146

See application file for complete search history.

(56) References Cited

U.S. PATENT DOCUMENTS

| | | | | |
|---|---|---|---|---|
| 1,918,732 | A * | 7/1933 | Adams | 335/136 |
| 1,993,946 | A | 3/1935 | Rhine | |
| 2,812,716 | A * | 11/1957 | Gray | 417/389 |
| 3,246,101 | A * | 4/1966 | Caputo | 335/115 |
| 3,378,796 | A * | 4/1968 | Caputo | 335/72 |
| 3,430,062 | A * | 2/1969 | Roth | 361/9 |
| 3,459,132 | A * | 8/1969 | Meyer | 417/417 |
| 3,635,593 | A * | 1/1972 | Moret | 417/417 |
| 4,105,879 | A * | 8/1978 | Tsukushi et al. | 218/59 |
| 4,529,953 | A * | 7/1985 | Myers | 335/126 |
| 2004/0245857 | A1 | 12/2004 | Liljestrand et al. | |
| 2006/0061442 | A1 * | 3/2006 | Brooks | 335/220 |
| 2012/0256711 | A1 * | 10/2012 | Liljestrand et al. | 335/1 |

OTHER PUBLICATIONS

European Search Report (EPO form 1507N) dated Dec. 6, 2011.

* cited by examiner

*Primary Examiner* — Mohamad Musleh

(74) *Attorney, Agent, or Firm* — Buchanan Ingersoll & Rooney PC

(57) ABSTRACT

A medium or high voltage switch has a switching assembly actuated by two drives. Each drive includes a plunger arranged between two Thomson coils. The coils as well as the plunger are rectangular for reducing the weight and therefore inertia of the drive and thus to increase drive speed.

20 Claims, 3 Drawing Sheets

FAST SWITCH WITH NON-CIRCULAR THOMSON COIL

RELATED APPLICATION

This application claims priority under 35 U.S.C. §119 to European Patent Application No. 11173994.2 filed in Europe on Jul. 14, 2011, the content of which is hereby incorporated by reference in its entirety.

FIELD

This disclosure relates to a high or medium voltage switch including a switching assembly adapted to form a conducting path between a first and a second terminal.

BACKGROUND

A known switch of this type, for example, as disclosed in US 2004/0245857, has a switching assembly and a drive adapted to actuate the switching assembly. The drive includes a plunger displaceable along a displacement direction and driven by a Thomson coil, e.g., a drive where a conducting member adjacent to a coil is subjected to a repulsive force upon application of a current pulse to the coil. The current pulse in the coil generates a varying magnetic flux, which in turn generates a current with opposite direction in the plunger. This generates a repulsive force between the coil and the plunger for driving the plunger away from the coil. This actuating principle is suitable to operate contact systems in electrical switches where extreme speed is called for.

SUMMARY

An exemplary high or medium voltage switch is disclosed comprising: a first and a second terminal; a switching assembly having a first and a second configuration, wherein in said first configuration, said switching assembly forms at least one conducting path between said terminals and wherein in said second configuration said switching assembly does not form a conducting path between said terminals; at least one drive for moving said switching assembly at least one of from said first to said second and from said second to said first configuration, wherein said at least one drive comprises an at least partially conductive plunger movable along a displacement direction between a first and a second location and connected to said switching assembly; at least one non-circular drive coil positioned adjacent to said plunger; and a current pulse generator adapted to generate a current pulse in said at least one drive coil for driving said plunger away from said at least one drive coil.

An exemplary high or medium voltage switch is disclosed, comprising: a first and a second terminal; a switching assembly having a first and a second configuration, wherein in said first configuration at least one of a plurality of contacts between said terminals is closed and in said second configuration at least one of the plurality of contacts between said terminals is open; at least one drive including a partially conductive plunger, said at least one drive moving respective contacts of said switching assembly from said first configuration to said second configuration or from said second configuration to said first configuration, wherein said plunger is connected to the respective contact of said switching assembly and is movable along a displacement direction between a first and a second location; a non-circular drive coil positioned adjacent to said plunger; and a current pulse generator adapted to generate a current pulse in said drive coil for driving said plunger away from said drive coil.

DESCRIPTION OF THE DRAWINGS

The disclosure will be better understood and objects other than those set forth above will become apparent from the following detailed description thereof. Such description makes reference to the annexed drawings, which show exemplary embodiments.

DETAILED DESCRIPTION

Figure 1:
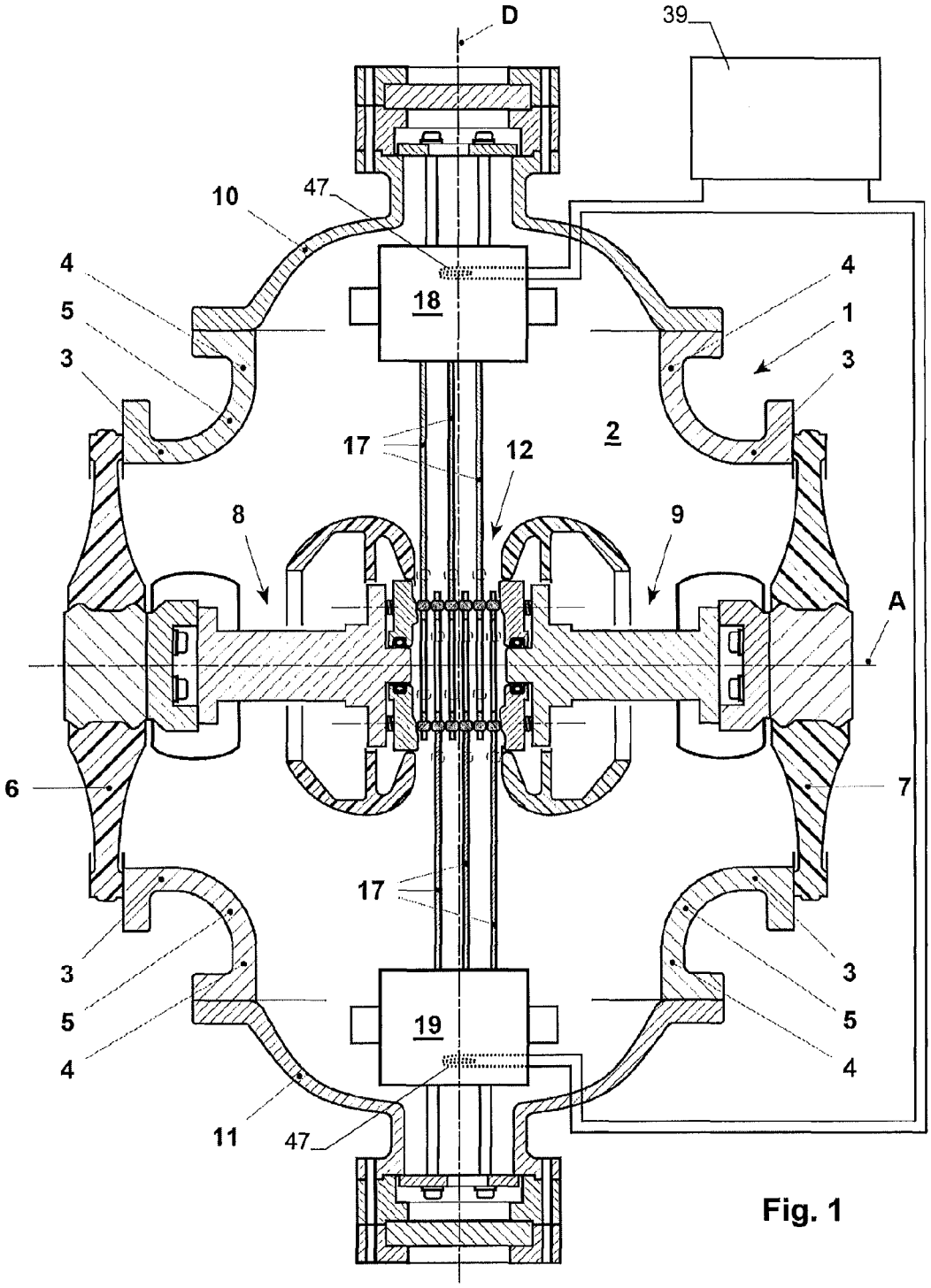
FIG. 1 shows a cross-sectional view of a switch in accordance with an exemplary embodiment of the present disclosure.

Exemplary embodiments of the present disclosure provide an improved switch that includes a first and a second terminal for applying the current to be switched. Further, it has a switching assembly having a first and a second configuration and a drive adapted to move the switching assembly from the first to the second and/or from the second to the first configuration. The switching assembly is structured such that in a first configuration the assembly forms one or more conducting paths between the terminals, e.g., the switch is in the closed, conducting configuration; and in a second configuration the assembly does not form the path, e.g., the switch is in its opened, non-conducting configuration.

An exemplary drive of the present disclosure includes an at least partially conductive plunger moving along a displacement direction between a first and a second location. The plunger is mechanically connected to the switching assembly for actuating the switching assembly. The drive further includes a drive coil positioned adjacent to the plunger for acting as a Thomson coil and a current pulse generator adapted to generate a current pulse in the drive coil in order to drive the plunger away from the drive coil.

According to the disclosure, the drive coil is non-circular and therefore deviates from the commonly used circular design of Thomson coils. This allows the coil to be adapted to the shape of the plunger and to use non-circular plungers. Hence, the dimensions of the plunger can be optimized, e.g., the plunger can be made smaller, which allows for a reduction in weight and therefore allows a faster switching speed to be achieved due to reduced inertia. Also, the non-circular design allows the drive more compact.

In an exemplary embodiment of the present disclosure, the drive coil is arranged in a region extending around the displacement direction, wherein said region is contained between an inner and an outer rectangle. The rectangles have parallel edges and are concentric to the displacement direction. The smaller edge length of the outer rectangle is smaller than the diameter of the inner rectangle, thus leading to a substantially rectangular design of the drive coil.

In an exemplary embodiment, the plunger can be substantially rectangular too, with edges parallel to the inner and outer rectangles. This design is especially well-suited if the mechanical connection between the plunger and the switching assembly has substantially rectangular cross section, e.g. if it includes a plurality of actuator rods arranged in a row or a rectangular matrix.

In another exemplary embodiment, the switching assembly can be arranged in a fluid-tight housing containing an electrically insulating fluid (e.g., a liquid or a gas), the drive can be arranged within the housing, thus obviating the use of mechanical bushings.

In exemplary embodiments disclosed herein, the switch can be used in high voltage applications (e.g., for voltages above 72 kV), and it can also be used for medium voltage applications (e.g., between some kV and 72 kV).

FIG. 1 shows a cross-sectional view of a switch in accordance with an exemplary embodiment of the present disclosure. As shown in FIG. 1, an exemplary switch can include a fluid-tight housing 1 enclosing a space 2 filled with an insulating fluid, such as $SF_6$ or air at elevated pressure or other insulating gas, e.g. fluoroketone or a mixture of air and fluoroketone, or an oil.

Housing 1 forms a GIS-type metallic enclosure and comprises two tube sections. A first tube section 3 extends along an axial direction A, and a second tube section 4 extends along a direction D, which is called the displacement direction for reasons that will become apparent below. In an exemplary embodiment of the present disclosure, axial direction A is perpendicular or nearly perpendicular to displacement direction D. The tube sections are formed by a substantially cross-shaped housing section 5.

First tube section 3 ends in first and second support insulators 6 and 7, respectively. First support insulator 6 carries a first terminal 8 and second support insulator 7 carries a second terminal 9 of the switch. The two terminals 8, 9 extending through the support insulators 6, 7 carry the current through the switch, substantially along axial direction A.

Second tube section 4 ends in a first and a second cap 10 and 11, respectively.

First terminal 8 and second terminal 9 extend towards a center of space 2 and end at a distance from each other, with a switching assembly 12 located between them, at the intersection region of first tube section 3 with second tube section 4.

Figure 2:
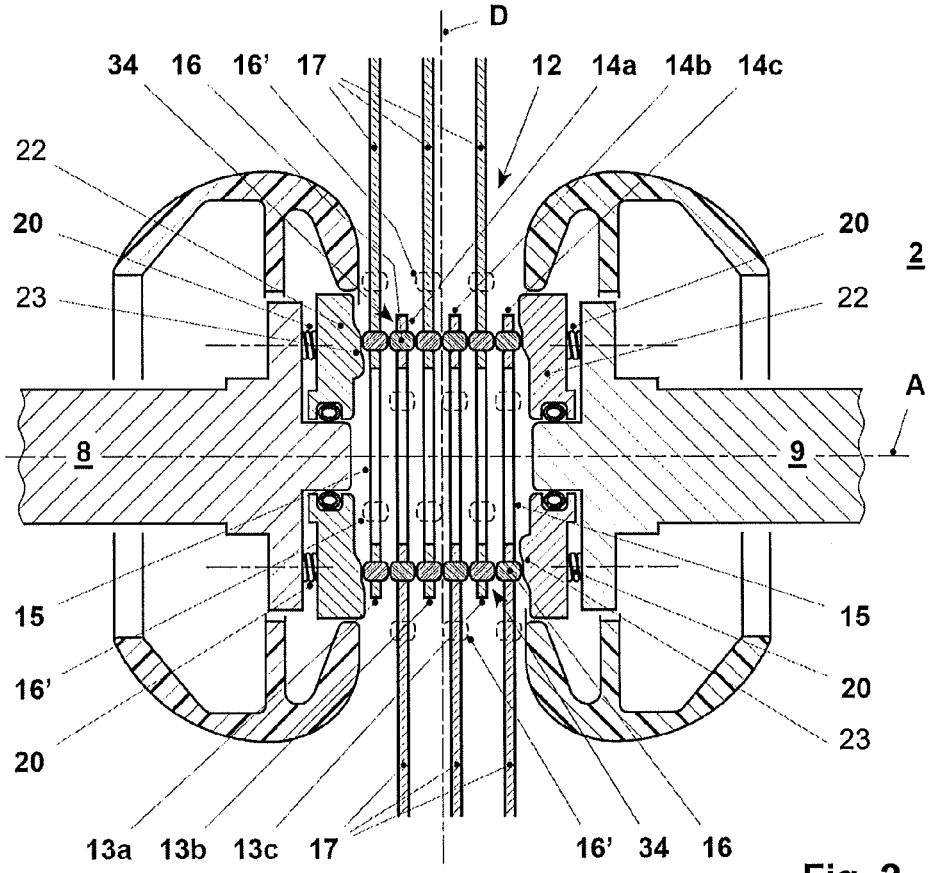
FIG. 2 shows an enlarged cross-sectional view of exemplary contact elements in accordance with an exemplary embodiment of the present disclosure.

FIG. 2 shows an enlarged cross-sectional view of exemplary contact elements in accordance with an exemplary embodiment of the present disclosure. As shown in FIG. 2, switching assembly 12 includes a first set of contact elements 13*a*, 13*b*, 13*c* and a second set of contact elements 14*a*, 14*b*, 14*c*. In the embodiment shown here, each set comprises three contact elements, but that number may vary, and, for example, be two or more than three. The first and second set may also have different numbers of contact elements, e.g. two and three, respectively. Advantageously, the number is at least two contact elements per set. The contact elements of the two sets are stacked alternatingly, e.g., each contact element of one set is adjacent to two contact elements of the other set unless it is located at the end of switching assembly 12, in which case it is located between one contact element of the other set and one of the terminals 8, 9.

As shown in FIG. 2, each contact element includes a plate-shaped insulating carrier 15, one or more conducting elements 16 and an actuator rod 17. In the embodiment shown here, each carrier 15 carries two conducting elements 16.

FIGS. 1 and 2 show the switch in the closed state with the contact elements 13*a*, 13*b*, 13*c*, 14*a*, 14*b*, 14*c* in a first mutual position (e.g., corresponding to the first configuration of the switching assembly 12), where the conducting elements 16 align to form two conducting paths along axial direction A between the first and the second terminals 8, 9. The conducting paths carry the current between the terminals 8, 9. Their number can be greater than one in order to increase continuous current carrying capability.

The contact elements 13*a*, 13*b*, 13*c*, 14*a*, 14*b*, 14*c* can be moved along the displacement direction D into a second position, where the conducting elements 16 are staggered in respect to each other and do not form a conducting path (e.g., corresponding to the second configuration of the switching assembly 12). In the second position, the conducting elements 16' are separated from each other along direction D, thereby creating several contact gaps (e.g., two times the number of contact elements 13, 14), thereby quickly providing a high dielectric withstand level.

To achieve such a displacement, and as shown in FIG. 1, the actuator rods 17 are connected to two drives 18, 19. A first drive 18 is connected to the actuator rods 17 of the first set of contact elements 13*a*, 13*b*, 13*c*, and a second drive 19 is connected to the actuator rods 17 of the second set of contact elements 14*a*, 14*b*, 14*c*.

The actuator rods 17 are straight for minimum weight and maximum strength. They can have rectangular or non-rectangular cross-section.

In the exemplary embodiments shown in FIGS. 1 and 2, the switch is opened by pulling the actuator rods 17 away from the center of the switch, thereby bringing the conducting elements into their second, staggered position. Alternatively, the rods 17 can be pushed towards the center of the switch, which also allows to the conducting elements to be brought into a staggered position.

The drives 18, 19 operate on the repulsive Lorentz-force principle. Each drive is able to displace one set of contact elements along the displacement direction D. They are adapted and controlled to move the first and second sets in opposite directions at the same time in order to increase the travelling length and speed of displacement.

The drives 18, 19 are arranged in opposite end regions of second tube section 4.

As shown in FIG. 2, each terminal 8, 9 carries a contact plate 22 forming a contact surface 23 contacting the conducting elements 16 when the switch is in its first configuration. The contact plates 22 are mounted to the terminals 8, 9 in axially displaceable manner, with springs 20 elastically urging the contact surface 23 against the conducting elements, thereby compressing the conducting elements 16 in their aligned state for better conduction. In the exemplary embodiment of FIG. 2, helical compression springs 20 are used for this purpose, but other types of spring members can be used as well. Also, even though it is advantageous if there is at least one spring member in each terminal 8, 9, a compression force for the aligned conducting elements 16 can also be generated by means of a spring member or several spring members in only one of the terminals 8, 9.

Figure 3:
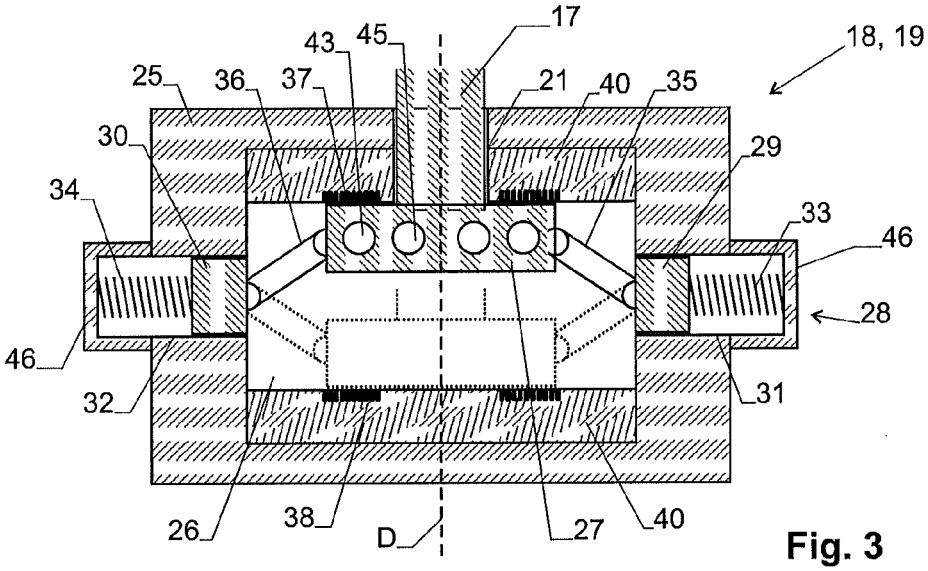
FIG. 3 shows a sectional view of a drive of a switch in accordance with an exemplary embodiment of the present disclosure.

FIG. 3 shows a sectional view of a drive of a switch in accordance with an exemplary embodiment of the present disclosure. FIG. 3 shows a schematic sectional view of a drive 18, 19. The drive 18, 19 includes a metal frame 25 enclosing a chamber 26. A plunger 27 is arranged within chamber 26 and held by a bistable suspension 28. Plunger 27 is connected to the actuator rods 17 of one set of contact element 13*a*, 13*b*, 13*c* or 14*a*, 14*b*, 14*c*, with the actuator rods 17 extending through an opening 21 in frame 25.

Bistable suspension 28 includes first and second pistons 29, 30 movable along bores 31, 32 in a direction perpendicular to displacement direction D. The pistons are pushed towards chamber 26 by means of first and second springs 33, 34. Each piston 29, 30 is connected to plunger 27 by means of a link 35, 36. Each link 35, 36 is formed by a substantially rigid rod, which is, at a first end, rotatably connected to its piston 29, 30, and, at a second end, rotatably connected to plunger 27.

The springs 33, 34, the pistons 29, 30 and the links 35, 36 together form several spring members biased against the edges of plunger 27. Since the springs 33, 34 urge the links 35, 36 against plunger 27, plunger 27 can assume two stable locations within bistable suspension 28, namely a first location as shown with solid lines in FIG. 3, as well as a second location as shown in dashed lines. The first location corresponds to the first configuration of the switching assembly, and the second location to the second configuration.

To operate plunger 27, first and second drive coils 37, 38 are arranged at opposite sides of chamber 26. Further, plunger 27 is of a conducting material, at least on its surfaces facing the drive coils 37, 38. In the first and second stable locations, plunger 27 is adjacent to first and second drive coil 37, 38, respectively.

Hence, when plunger 27 is e.g. in its first location and a current pulse is sent through first drive coil 37, a mirror current is generated within plunger 27, which leads to a repulsive force that accelerates plunger 27 away from first coil 37. The kinetic energy imparted on plunger 27 in this manner is sufficient to move plunger 27 against the bistable suspension 28 to its second location adjacent to second drive coil 38.

In the exemplary embodiment of FIG. 1, the two drives 18, 19 should be operated synchronously. A pulse generator 39 (see FIG. 1) is provided for this purpose. Pulse generator 39 is adapted to generate concurrent current pulses the first drive coils 37 of both drives 18 and 19 for opening the switch, as well as concurrent current pulses the second coils 38 of both drives 18 and 19 for closing the switch.

In exemplary embodiments of the present disclosure, a concurrent operation can easily be achieved by electrically arranging the first drive coils 37 of both switches in series, as shown by the feed lines between the drives 18, 19 and pulse generator 39 in FIG. 1. Similarly, the second drive coils 38 of both switches should advantageously be arranged in series as well.

As can be seen in FIG. 3, each drive coil 37, 38 is, on a side facing away from plunger 27, embedded in an electrically insulating holder 40. Insulating holder 40 abuts, on its side facing away from drive coil 37, 38, against metal frame 25. Thus, when the drive 18, 19 is operated and coil 37 is pushed against holder 40, the corresponding force is directly transferred to frame 25, which can be made of a stronger material than holder 40.

As can also be seen from FIG. 3, each drive coil 37, 38 is advantageously formed by a wire having rectangular cross section in order to optimally use available space.

As illustrated in FIG. 3, plunger 27 is further provided with at least one cavity 45, which allows for a reduction in weight. For example, at least 10%, or in other exemplary embodiments at least 25%, of the volume of plunger 27 should be formed of the cavity or cavities 45. A "cavity" in this context is any cavity in the bulk material of plunger 27. Such a cavity can optionally be filled with a lighter filler material.

Figure 4:
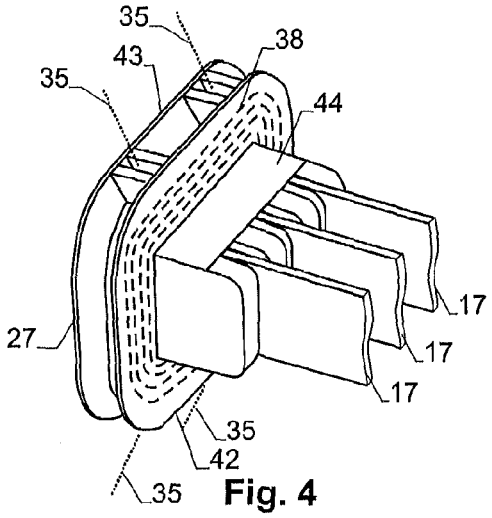
FIG. 4 shows a plunger of a switch connected to the actuating rods in accordance with an exemplary embodiment of the present disclosure.
Figure 5:
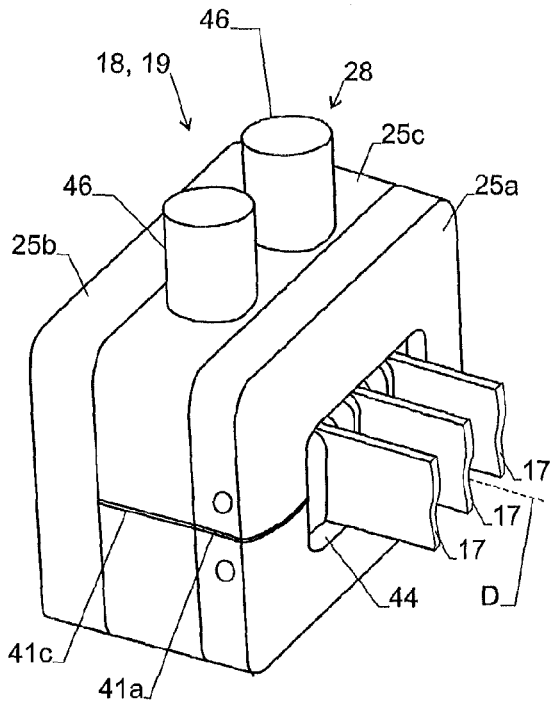
FIG. 5 shows a single drive of a switch with the exemplary plunger of FIG. 4 in accordance with an exemplary embodiment of the present disclosure.

FIG. 4 shows a plunger of a switch connected to the actuating rods in accordance with an exemplary embodiment of the present disclosure. FIG. 5 shows a single drive of a switch with the exemplary plunger of FIG. 4 in accordance with an exemplary embodiment of the present disclosure. As shown, plunger 27 is connected to the driving rods 17 by means of an adapter member 44. If the driving rods 17 are arranged, as shown in FIG. 4, along a single row, or in a rectangular matrix, adapter member 44 has roughly rectangular shape. Similarly, the coils 37, 38 (as shown, for example, in FIG. 4 for coil 38) are arranged in substantially rectangular regions. As mentioned above, this design allows for a reduction in weight of the plunger, which, in turn, can provide a faster switch.

In the exemplary embodiment of FIG. 5, frame 25 includes three sections 25*a*, 25*b*, 25*c*, each of which extends around displacement direction D. In each section, an insulating gap is formed. The gaps 41*a*, 41*c* of sections 25*a* and 25*c* can be seen in FIG. 5, while the gap of section 25*b* remains hidden by the drive's body. As already discussed, these gaps prevent inductive currents from flowing in the three sections 25*a*, 25*b*, and 25*c* of frame 25 around displacement direction D.

The opening 21 formed in frame 25 is substantially rectangular. The actuator rods 17 and/or adapter member 44 extend through opening 21. Opening 21 is arranged on the side of frame 25 that faces switching assembly 12, while on the side facing away from switching assembly frame 25 is advantageously closed.

Further, FIGS. 4 and 5 show the design of the bistable suspension 28. FIG. 4 illustrates an exemplary location of the links 35. At least two links 35 and therefore spring members are biased against a first edge 42, and at least two links 35 and therefore spring members are biased against a second edge 43 of plunger 27, with second edge 43 being opposite to first edge 42. Each spring member is covered by a cap 46. FIG. 5 shows two caps 46 on one side of the drive 18, 19, with two further caps being arranged on the other side. This exemplary design improves the stability of plunger 27 in its bistable suspension 28, for example, if the edges 42, 43 are the longer edges of the substantially rectangular plunger 27.

Figure 6:
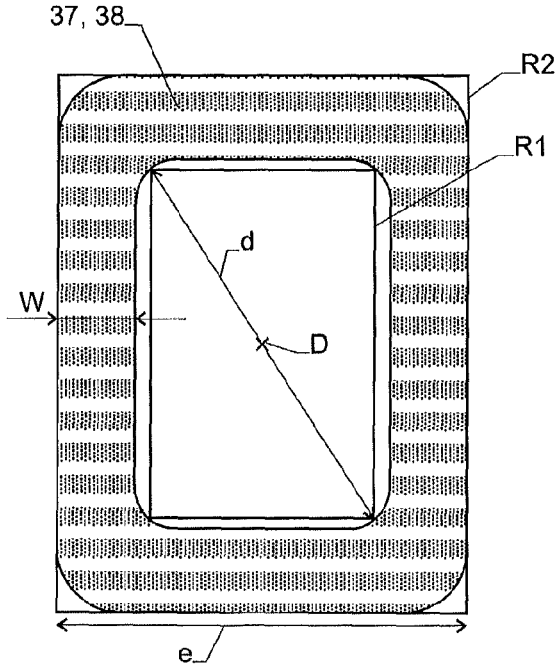
FIG. 6 depicts a shape of a driving coil in accordance with an exemplary embodiment of the present disclosure.

FIG. 6 depicts a shape of a driving coil in accordance with an exemplary embodiment of the present disclosure. In another exemplary embodiment, the drive coils 37, 38 as well as plunger 27 and opening 21 are "substantially rectangular". This term is defined for drive coils 37, 38 in reference to FIG. 6, which shows, in a view parallel to displacement direction D, the region of drive coil 37, 38. Coil 37 or 38 is assumed to be substantially rectangular, if the coil is arranged in a region that is contained between an inner (R1) and an outer (R2) rectangle as shown in FIG. 6, the rectangles R1, R2 have the following properties:

A) Both have parallel edges;

B) Both are concentric to displacement direction D; and

C) For both, the smaller edge length e (e.g., the length of the smaller edge) of outer rectangle R2 is smaller than the diameter d of inner rectangle R1 (e.g., $e<d$).

As should be readily apparent, it can be difficult to fit a circle between the rectangles R1, R2, but a substantially rectangular curve will fit.

The above condition C can be broadened by taking the radial width W of the coil into account. The radial width W is shown in FIG. 6 and it corresponds to the shortest radial distance between the inner side of the innermost winding of the coil and the outer side of the outermost winding of the coil. In that case, condition C can be formulated as C', as follows:

C') the radial width W of the coil is larger than $(e-d)/2$, with e being the smaller edge length (e.g., the length of the smaller edge) of outer rectangle R2 and d being the diameter of inner rectangle R1.

As shown in the Figures, it can be difficult to fit a circular coil of radial width W between the rectangles R1, R2, but a substantially rectangular coil will fit with more ease.

In a more narrow and advantageous definition, the diameters of the rectangles R1 and R2 should not differ by more than 80% of the diameter of the outer rectangle R2, for example.

Similarly, plunger 27 and opening 21 can be "substantially rectangular" if their circumference fits between the two rectangles R1, R2 of FIG. 6 fulfilling the conditions A, B and C above.

According to exemplary embodiments of the present disclosure, a drive can also be used in switches different from the one shown in FIGS. 1 and 2. A switch using an exemplary drive can also contain a single drive only, or it can use a different type of switching assembly. A switch using the present drive can, for example, be a fast acting earthing switch, a disconnector, a combined disconnector and earthing switch (e.g., a three-position switch), a load-break switch, a circuit breaker or the like.

Furthermore, depending on the geometry of the mechanical connection between the plunger 27 and the switching assembly 12, plunger 27 and the drive coils 37, 38 do not have to be substantially rectangular. They may take another non-circular shape, such as triangular, oval or hexagonal. However, a rectangular design can be best suited for most types of connections.

In the exemplary embodiments disclosed herein, there are two coils per drive for driving the plunger in opposite directions. Other exemplary embodiments, however, can also be carried out with a drive with only one coil. In these embodiments, the movement of the plunger into the direction towards the coil can be generated by other means, e.g. elastically, pneumatically, or other driving means as desired, or there may be two drives for each actuator.

Also, only one set of contact elements of the switch could be movable, while the other one is stationary.

While there are shown and described presently exemplary embodiments of the disclosure, it is to be distinctly understood that the disclosure is not limited thereto but may be otherwise variously embodied and practiced within the scope of the following claims.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE NUMBERS

1: housing
2: space
3, 4: tube sections
5: housing section
6, 7: support insulators
8, 9: terminals
10, 11: caps
12: switching assembly
13*a*, 13*b*, 13*c*: first set of contact elements
14*a*, 14*b*, 14*c*: second set of contact elements
15: insulating carrier
15*a*, 15*b*: axial surfaces of insulating carrier
16, 16': conducting elements
17: actuator rods
18: drive
19: drive
20: springs
21: opening
22: contact plate
23: contact surface
25: frame
26: chamber
27: plunger
28: bistable suspension
29, 30: pistons
31, 32: bores
33, 34: springs
35, 36: links
37, 38: drive coils
39: pulse generator
40: holder
41: insulating gap
42, 43: first edge, second edge
44: adapter member
45: cavities
46: spring member caps

What is claimed is:

1. A high or medium voltage switch, comprising:

a first and a second terminal;

a switching assembly having a first and a second configuration, wherein in said first configuration, said switching assembly forms at least one conducting path between said terminals and wherein in said second configuration said switching assembly does not form a conducting path between said terminals;

at least one drive for moving said switching assembly at least one of from said first configuration to said second configuration and from said second configuration to said first configuration, wherein said at least one drive comprises an at least partially conductive plunger movable along a displacement direction between a first and a second location and connected to said switching assembly;

a plurality of actuator rods arranged in a row or rectangular matrix and connected to said plunger via an adapter member, wherein the plunger and adapter member are enclosed in a frame having an opening through which at least the plurality of actuator rods extend;

at least one non-circular drive coil positioned adjacent to said plunger; and a current pulse generator adapted to generate a current pulse in said at least one drive coil for driving said plunger away from said at least one drive coil.

2. The switch of claim 1, wherein said at least one drive coil is arranged in a region extending around said displacement direction, wherein said region is contained between an inner and an outer rectangle, wherein said rectangles have parallel edges and are concentric to said displacement direction, wherein a radial width of said coil is larger than (e−d)/2, where e is a smaller edge length of said outer rectangle and d is a diameter of said inner rectangle.

3. The switch of claim 1, wherein said at least one drive coil is arranged in a region extending around said displacement direction, wherein said region is contained between an inner and an outer rectangle, wherein said rectangles have parallel edges and are concentric to said displacement direction, and wherein a smaller edge length of said outer rectangle is smaller than a diameter of said inner rectangle.

4. The switch of claim 2, wherein said plunger is substantially rectangular with edges parallel to said inner and said outer rectangles.

5. The switch of claim 2, wherein said frame opening is substantially rectangular.

6. The switch of claim 5, wherein said plunger is arranged in a bistable suspension, with said first and second location forming stable states of said bistable suspension.

7. The switch of claim 6, wherein the bistable suspension comprises at least four spring members, wherein at least two of said spring members are biased against a first edge of said plunger and at least two spring members are biased against a second edge of said plunger, with said second edge being opposite to said first edge.

8. The switch of claim 1, wherein said plurality of actuator rods extend between said plunger and said switching assembly.

9. The switch of claim 1, wherein on a side facing away from said plunger, said at least one drive coil is embedded in an electrically insulating holder, and wherein, on a side facing away from said at least one drive coil, said insulating holder abuts against a metal frame.

10. The switch of claim 9, wherein said frame extends around said displacement direction and comprises an insulating gap for interrupting electrical currents from flowing in said frame around said displacement direction.

11. The switch of claim 9, wherein said switching assembly is encapsulated in a fluid-tight housing, wherein said fluid-tight housing contains an electrically insulating fluid surrounding said switching assembly, and wherein said drive is arranged within the housing.

12. The switch of claim 9, wherein said plunger comprises at least one cavity.

13. A high or medium voltage switch, comprising:

a first and a second terminal;

a switching assembly having a first and a second configuration, wherein in said first configuration at least one of a plurality of contacts between said terminals is closed and in said second configuration at least one of the plurality of contacts between said terminals is open;

at least one drive including a partially conductive plunger, said at least one drive moving respective contacts of said switching assembly from said first configuration to said second configuration or from said second configuration to said first configuration, wherein said plunger is connected to the respective contact of said switching assembly and is movable along a displacement direction between a first and a second location;

a plurality of actuator rods arranged in a row or rectangular matrix and connected to said plunger via an adapter member, wherein the plunger and adapter member are enclosed in a frame having an opening through which at least the plurality of actuator rods extend;

a non-circular drive coil positioned adjacent to said plunger; and a current pulse generator adapted to generate a current pulse in said drive coil for driving said plunger away from said drive coil.

14. The switch of claim 1, wherein said at least one drive coil is arranged in a region extending around said displacement direction, wherein said region bordered by an inner and an outer rectangle, wherein a radial width of said coil is larger than $(e-d)/2$, where e is a smaller edge length of said outer rectangle and d is a diameter of said inner rectangle.

15. The switch of claim 14, wherein said rectangles have parallel edges and are concentric to said displacement direction.

16. The switch of claim 1, wherein said at least one drive coil is arranged in a region extending around said displacement direction, and wherein a smaller edge length of said outer rectangle is smaller than a diameter of said inner rectangle.

17. The switch of claim 16, wherein said region is bordered an inner and an outer rectangle.

18. The switch of claim 16, wherein said rectangles have parallel edges and are concentric to said displacement direction.

19. The switch of claim 1, wherein the frame includes three sections that extend around the displacement direction, each section having an insulating gap that prevents the flow of inductive current in said displacement direction.

20. The switch of claim 13, wherein the frame includes three sections that extend around the displacement direction, each section having an insulating gap that prevents the flow of inductive current in said displacement direction.

* * * * *